US008572905B1

(12) United States Patent
Driggers

(10) Patent No.: US 8,572,905 B1
(45) Date of Patent: Nov. 5, 2013

(54) METHOD AND APPARATUS FOR ANCHORING BEAM

(76) Inventor: Tab F. Driggers, New Brockton, AL (US)

( * ) Notice: Subject to any disclaimer, the term of this patent is extended or adjusted under 35 U.S.C. 154(b) by 20 days.

(21) Appl. No.: 13/339,094

(22) Filed: Dec. 28, 2011

(51) Int. Cl.
*E02D 27/42* (2006.01)

(52) U.S. Cl.
USPC ..... 52/169.9; 52/170; 52/169.13; 52/298; 52/295

(58) Field of Classification Search
USPC ..... 52/155, 156, 165, 160, 274, 23, 52/294–297, 169.8, 169.9, 169.13, 176, 52/DIG. 11, 298
See application file for complete search history.

(56) References Cited

U.S. PATENT DOCUMENTS

| | | | | |
|---|---|---|---|---|
| 887,217 | A * | 5/1908 | Oliphant | 52/295 |
| 1,585,254 | A * | 5/1926 | Lund et al. | 52/698 |
| 2,029,439 | A | 2/1936 | Ochiltree | |
| 2,673,053 | A * | 3/1954 | Kilian | 248/153 |
| 3,581,508 | A * | 6/1971 | Junius | 405/255 |
| 4,272,929 | A * | 6/1981 | Hanson | 52/40 |
| D277,643 | S | 2/1985 | Fambrough | |
| 5,135,192 | A | 8/1992 | Winkler | |
| 5,383,319 | A * | 1/1995 | Sorqvist | 52/741.1 |
| 5,794,921 | A * | 8/1998 | Greenberg | 256/19 |
| 6,219,989 | B1 * | 4/2001 | Tumura | 52/838 |
| 6,851,234 | B2 * | 2/2005 | Hoffman et al. | 52/299 |
| 7,090,117 | B2 | 8/2006 | Lackey et al. | |
| 7,325,790 | B2 | 2/2008 | Lee | |
| 7,343,713 | B2 * | 3/2008 | Knepp et al. | 52/126.1 |
| 7,444,787 | B2 * | 11/2008 | Cutforth | 52/295 |
| 7,610,733 | B2 * | 11/2009 | Rizzotto | 52/745.21 |
| 7,621,097 | B2 * | 11/2009 | Wilhour | 52/741.15 |
| 7,627,994 | B1 * | 12/2009 | Demirkan | 52/165 |
| 7,722,014 | B2 | 5/2010 | Godwin | |
| 7,921,616 | B2 * | 4/2011 | Reyneveld | 52/295 |
| 8,056,299 | B2 * | 11/2011 | Liskey | 52/742.14 |
| 8,261,966 | B2 * | 9/2012 | Cox et al. | 232/47 |
| 8,347,584 | B2 * | 1/2013 | Fehr et al. | 52/741.15 |
| 8,365,485 | B2 * | 2/2013 | Reyneveld | 52/295 |
| 2005/0204686 | A1 * | 9/2005 | Meyer et al. | 52/720.1 |

FOREIGN PATENT DOCUMENTS

| | | | | |
|---|---|---|---|---|
| JP | 61233131 A | * | 10/1986 | E02D 27/42 |

* cited by examiner

*Primary Examiner* — Joshua J Michener
*Assistant Examiner* — Elizabeth A Plummer
(74) *Attorney, Agent, or Firm* — George L Williamson

(57) ABSTRACT

Method and apparatus for anchoring and supporting a member in an upright position in the ground. An upper portion disposed above the ground receives and supports the upright member along with a lower portion disposed beneath the surface of the ground in a manner so as to secure the member in an upright position. The upper portion is attached to the lower portion using an anchor plate secured to the lower portion using threaded studs which are mounted into the cement of the foundation. The anchor plate is attached to a lower box sunk into the cement foundation with the lower box being secured into the foundation using a plurality of generally upright standing rebars.

13 Claims, 5 Drawing Sheets

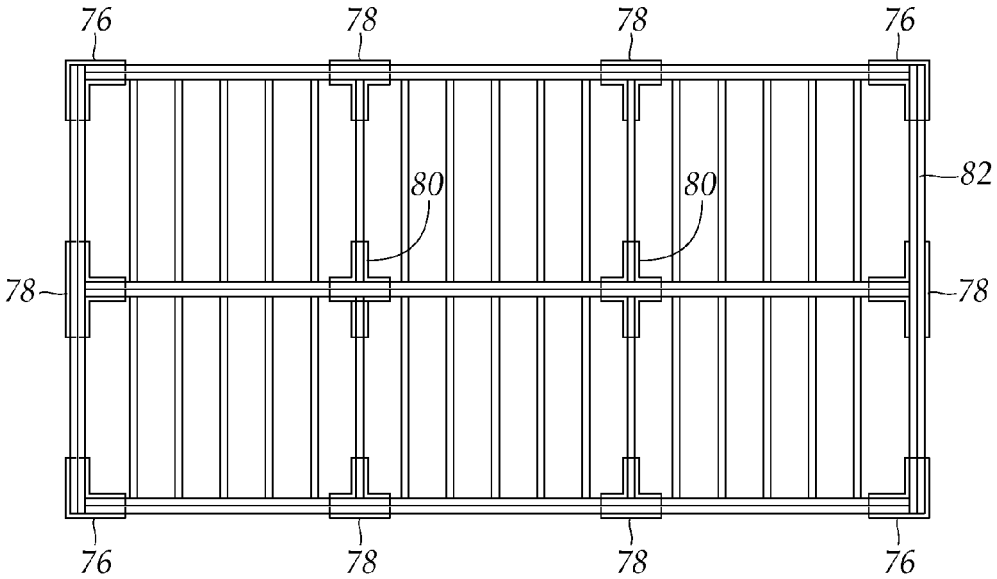
FIG. 11
FIG. 12
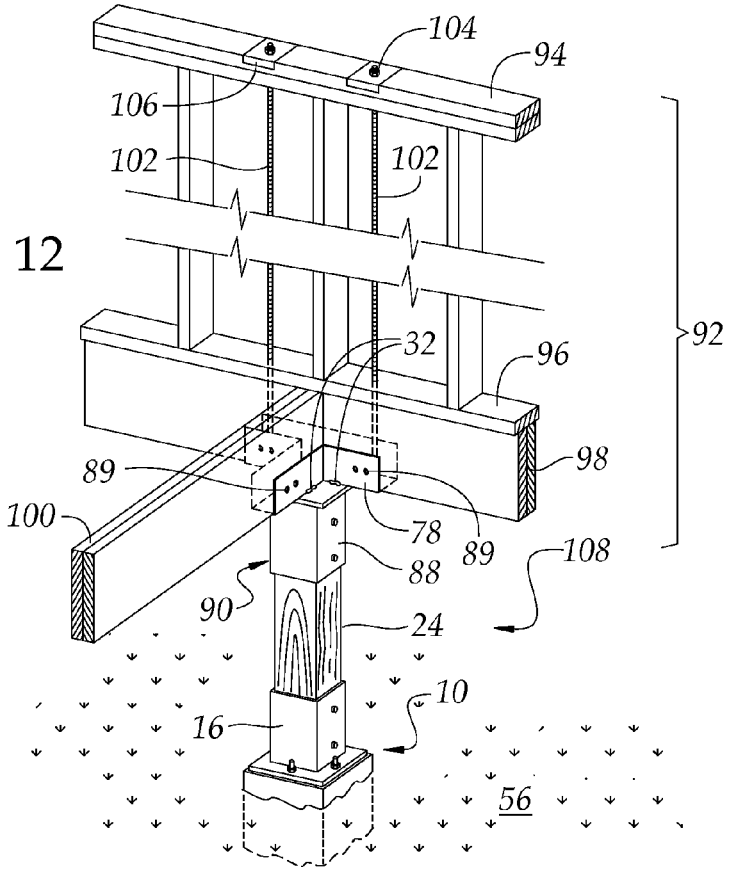

METHOD AND APPARATUS FOR ANCHORING BEAM

BACKGROUND OF THE INVENTION

1. Field of the Invention

The present invention relates generally to ground anchors and, more particularly, is concerned with a method and apparatus for anchoring a beam, such as a pole, in the ground.

2. Description of the Related Art

Ground anchors have been described in the related art, however, none of the related art devices disclose the unique features of the present invention.

In U.S. Pat. No. 2,029,439 dated Feb. 4, 1936, Ochiltree disclosed a fence post mountable in the ground. In U.S. Pat. No. 5,135,192 dated Aug. 4, 1992, Winkler disclosed a ground anchor. In U.S. Pat. No. D277,643 dated Feb. 19, 1985, Fambrough disclosed a holder and ground anchor unit for a rectangular fence post. In U.S. Pat. No. 7,090,117 dated Aug. 15, 2006, Lackey, et al., disclosed a ground mount post. In U.S. Pat. No. 7,325,790 dated Feb. 5, 2008, Lee disclosed a post setting insert. In U.S. Pat. No. 7,722,014 dated May 25, 2010, Godwin disclosed a surface mount. In U.S. Patent Application Publication No. 2009/0272053 dated Nov. 5, 2009, Dent disclosed a ground anchor assembly.

While these ground anchors may be suitable for the purposes for which they were designed, they would not be as suitable for the purposes of the present invention as hereinafter described.

SUMMARY OF THE PRESENT INVENTION

The present invention discloses a method and apparatus for supporting a post or beam member in an upright position in a manner that allows the member to be secured into the ground. The present invention comprises an upper portion which is disposed above the ground which receives and supports the upright member and a lower portion which is secured beneath the surface of the ground in a manner so as to secure the member in an upright position. The upper portion is attached to the lower portion using an anchor plate which is secured to the lower portion using threaded studs which are mounted into the cement of the foundation. The anchor plate is attached to a lower enclosure box which is sunk into the cement foundation with the lower box being secured into the foundation using a plurality of generally upright standing rebars.

An object of the present invention is to provide a means of securely attaching a post or beam into the ground. A further object of the present invention is to provide a means for attaching a supporting beam in an upright position using a device which is extremely strong for attachment into the ground so that the beam is held securely in an upright position. A further object of the present invention is to provide a means for supporting a beam in an upright position which can be easily used by an operator of the present invention. A further object of the present invention is to provide a means for supporting a beam in an upright position which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 11 is a plan view of a typical foundation of a building.

FIG. 12 is a perspective view of a typical wall section of a building.

LIST OF REFERENCE NUMERALS

Figure 1:
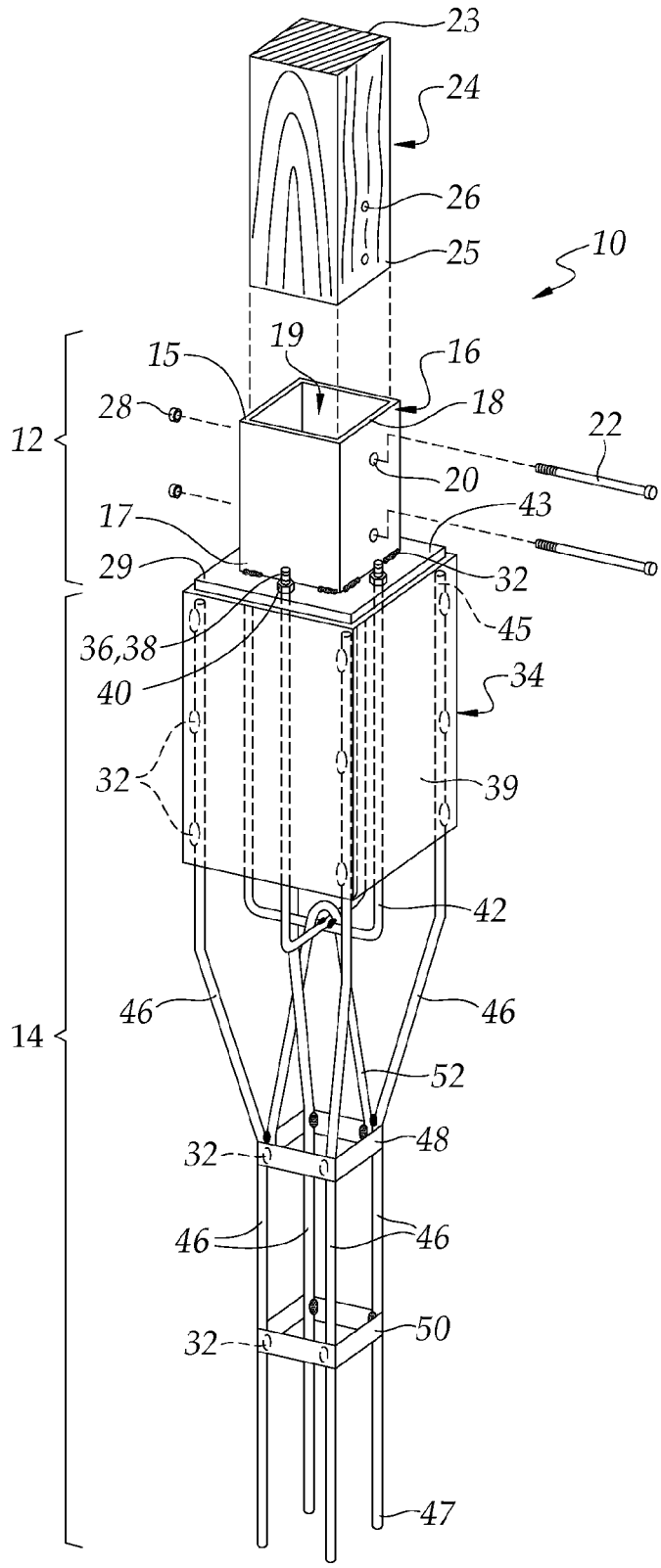
FIG. 1 is a perspective view of the present invention.

With regard to reference numerals used, the following numbering is used throughout the drawings.

| | |
|---|---|
| 10 | present invention |
| 12 | upper portion |
| 14 | lower portion |
| 15 | upper end of receptacle |
| 16 | receptacle |
| 17 | lower end of receptacle |
| 18 | walls |
| 19 | bore |
| 20 | aperture |
| 22 | lag bolt |
| 23 | upper end of beam member |
| 24 | post/beam member |
| 25 | lower end of beam member |
| 26 | aperture |
| 28 | nut |
| 29 | upper surface of base plate |
| 30 | anchor/base plate |
| 31 | lower surface of base plate |
| 32 | spot weld |
| 33 | upper end of enclosure |
| 34 | grade box/enclosure |
| 35 | lower end of enclosure |
| 36 | anchor bolt |
| 37 | inner surface of enclosure |
| 38 | threaded portion |
| 39 | outer surface of enclosure |
| 40 | fastener |
| 41 | interior of enclosure |
| 42 | lower end |
| 43 | flange |
| 44 | cement |

-continued

| | |
|---|---|
| 45 | upper end of rebar |
| 46 | rebar |
| 47 | lower end of rebar |
| 48 | upper band |
| 50 | lower band |
| 52 | joining rebar |
| 54 | hole |
| 56 | soil |
| 58 | bottom of hole |
| 60 | fence post |
| 62 | fence members |
| 64 | barn |
| 66 | corner post of barn |
| 68 | pole of street light |
| 70 | light |
| 72 | telephone pole |
| 74 | telephone lines |
| 76 | attachment |
| 78 | attachment |
| 80 | attachment |
| 82 | foundation of building |
| 84 | channel |
| 86 | anchor plate |
| 88 | receptacle |
| 89 | aperture |
| 90 | receptacle |
| 92 | wall section |
| 94 | top plate |
| 96 | bottom plate |
| 98 | floor joist |
| 100 | floor joist |
| 102 | all-thread rod |
| 104 | fastener |
| 106 | bracket |
| 108 | crawl space |

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 12 illustrate the present invention wherein a method and apparatus for supporting a beam in an upright position is disclosed.

Figure 2:
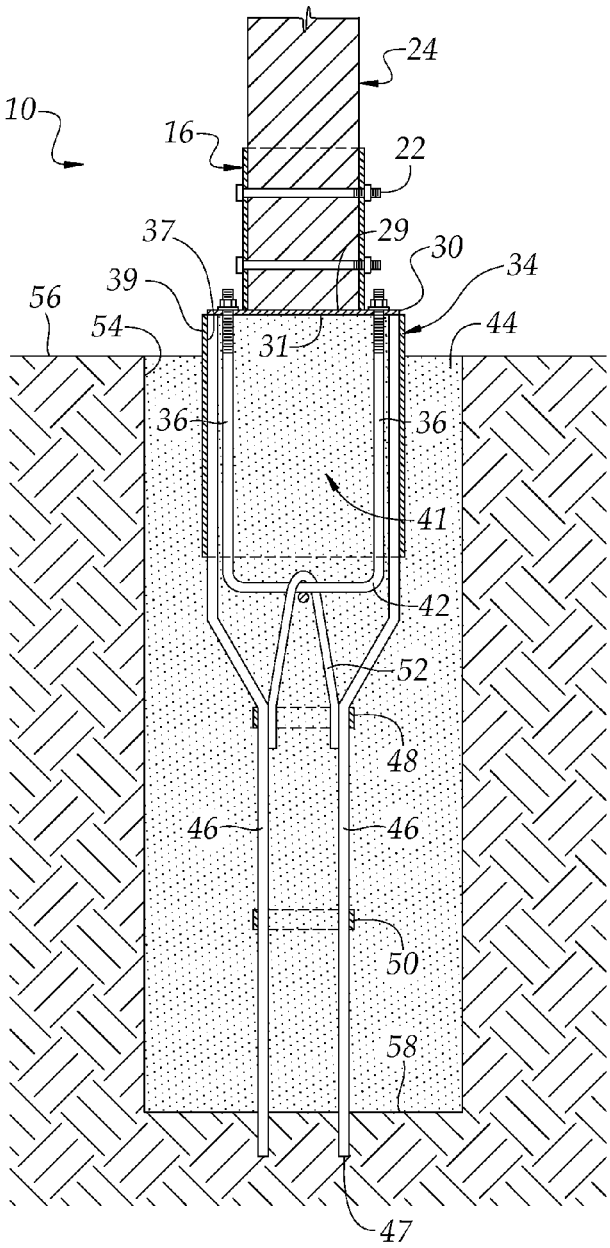
FIG. 2 is a cross sectional view of the present invention shown in operative connection.
Figure 3:
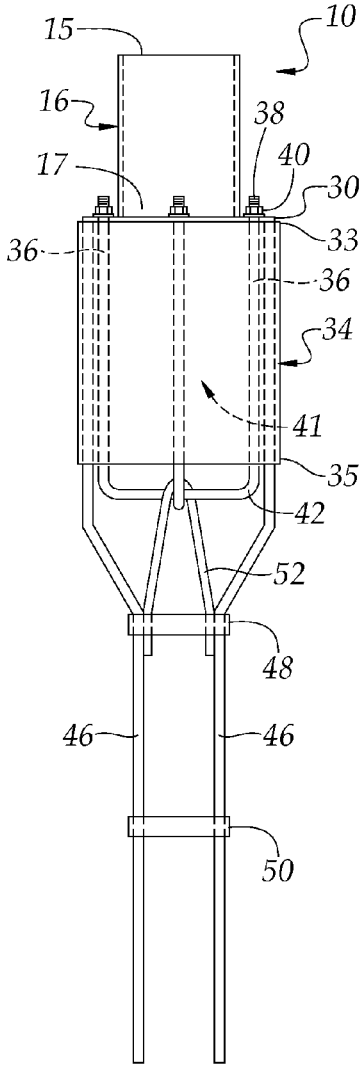
FIG. 3 is a side view of the present invention.

Turning to FIGS. 1-3, therein is shown the present invention 10 which has generally an upper, above ground portion 12 and a lower, below ground portion 14. The upper portion 12 comprises a receptacle 16 wherein the receptacle is shown as being square-shaped for illustration only. It should be clear that any shape receptacle could be used whether round, square, rectangular or the like for receiving a similarly shaped beam. The receptacle 16 has upper 15 and lower 17 ends, a bore 19 and an upstanding wall 18 having at least one aperture 20 therein for receiving at least one lag bolt 22 or the like therein. A post or beam member 24 having upper end portion 23 and lower end portion 25 and having holes or apertures 26 therein which mate to apertures 20 is shown which post has its lower end 25 disposed in the upper receptacle 16 being secured to the upper receptacle using the lag bolts 22 and nuts or fastener 28 as would be done in the standard manner by one skilled in the art. The upper receptacle 16 is secured to an anchor plate 30 using corner or spot welds 32 or the like. Spot welds 32 are used for illustration only and any means of securing the receptacle 16 to the anchor/base plate 30 would be acceptable. The lower portion 14 of the present invention 10 comprises an enclosure or grade box 34 having upper 33 and lower 35 end portions, inner 37 and outer 39 surfaces, an interior 41 which surrounds one or more anchor or U-bolts 36 which have upper threaded ends 38 having fasteners or nuts 40 or the like thereon so that the anchor bolts 36 can be secured to the anchor/base plate 30 which has upper 29 and lower 31 surfaces and a flange 43 thereon; all of this forms a structure which provides slight flexibility, at points of joinder between members, during high lateral wind conditions such as might occur in a tornado or hurricane which contributes to help make the present invention 10 extremely strong. Enclosure 34 extends about ⅓ of the distance between the top and the bottom of the rebars 46 to provide effectively strong support to the rebars. It should be clear that the present invention 10 could be configured to operate with any shape enclosure 34 whether round, square, rectangular or the like. It can be seen that the anchor bolts 36 are illustrated here as being U-bolts on their lower portions 42 which bolts are cast into a cement foundation 44 as shown in FIG. 2. U-bolts 36 may be made entirely of all-thread. Also shown are a plurality of reinforcing bars or rebars 46 having upper 45 and lower 47 end portions and which are also disposed or cast into the cement 44 as shown in FIG. 2 wherein the rebars are secured to each other by an upper band 48 and lower band 50 which bands are wrapped around the rebars, which are steel rods with ridges thereon, in a portion of the rebars having a smaller diameter than at the upper end of the rebars. Also shown is a center strap on rebar 52 which is secured to the lower portions 42 of the anchor bolts 36 and to the rebars 46 by spot welds 32 which is best shown in FIG. 2. It should be clear that upright member 24 could be made of any suitable material, e.g., wood, metal or concrete. The ends 47 of the rebars 46 extend an effectively long distance below the enclosure/grade box 34 and are cast an effective depth into the cement 44 and are disposed an effective depth into the ground 56, about 6 inches as shown in FIG. 2, so as to provide adequate vertical and lateral support to the beam 24 to support the beam in a high lateral wind conditions such as might occur in a tornado or hurricane. Rebars 46 or angled or bent inwardly toward the central axis of the present invention 10 at about ½ its length so that the rebars have a smaller diameter near the bottom portions than at the top portions to form somewhat of a leg near the lower portion of the rebars.

Turning to FIG. 2, therein is shown the present invention 10 additionally showing an edge of the hole 54 of a surrounding soil 56 having cement 44 placed therein for receiving the lower portion 14 of the present invention 10 therein. It should be clear that the present invention 10 provides an extraordinarily strong means for supporting a post or beam 24 in an upright position while anchoring the present invention 10 into the soil 56. It can be seen that cement 44 is poured from the bottom 53 of hole 54 up to the top portion of grade box 34 so that the U-bolts 42 are embedded almost completely in cement to provide stability to the U-bolts and anchor plate 30. The upper end 33 of the enclosure/grade box 34 is used as a point for surveying purposes with which to adjust the grade of the apparatus 10 which grade can be adjusted by adjusting the depth of the lower ends 47 of rebars 46 in the ground 56.

Figure 4:
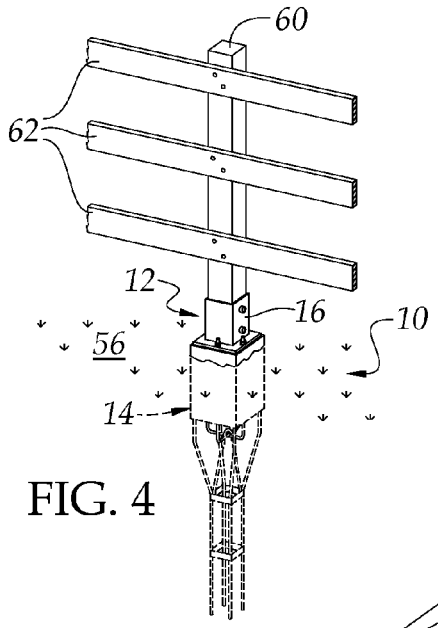
FIG. 4 is a perspective view of an embodiment of the present invention.

Turning to FIG. 4, therein is shown an exemplary use of the present invention 10 firmly anchored into the surrounding ground or soil 56 wherein the upper portion 12 is shown generally above the surface of the ground and a lower portion 14 is shown generally below the surface of the ground. In this embodiment a fence post 60 is shown for supporting the horizontal fence members 62 wherein the fence post 60 is secured in an upright position in the receptacle 16 while being secured into the ground.

Figure 5:
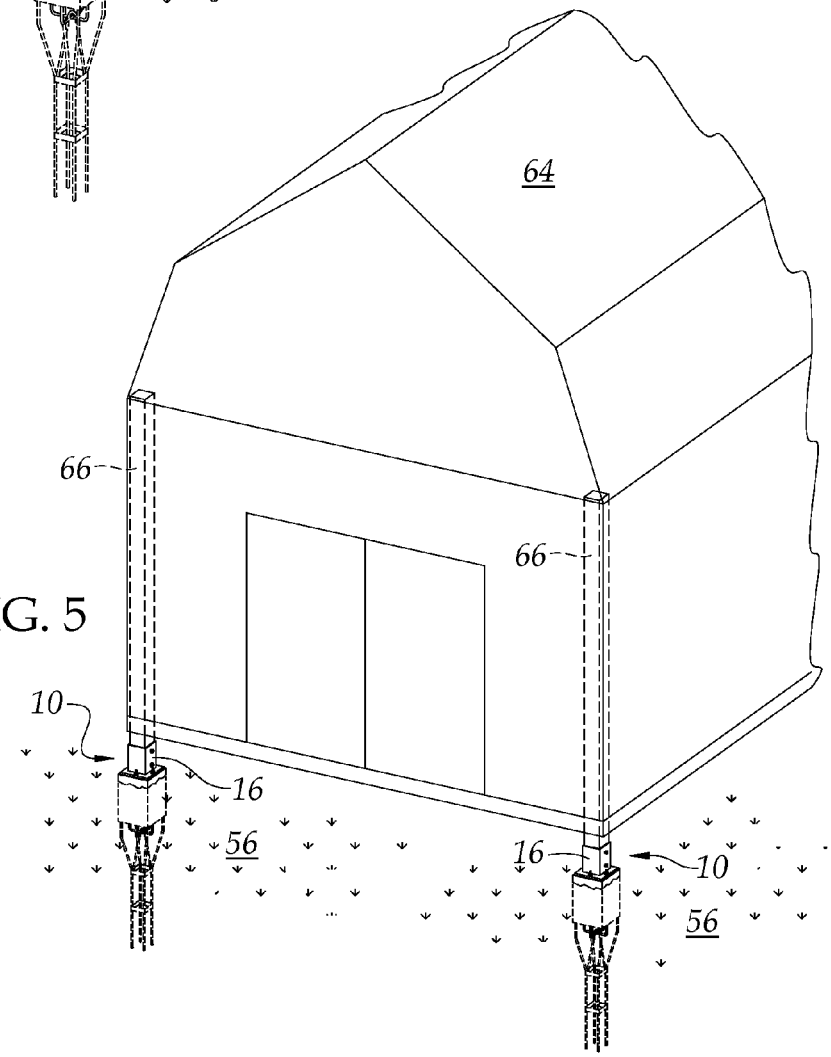
FIG. 5 is a perspective view of an embodiment of the present invention.

Turning to FIG. 5, therein is shown an exemplary use of the present invention 10 wherein a barn 64 or like is shown being constructed about a plurality of upright members 66 being a corner post of the barn 64 wherein the lower end portion of the upright member 66 is secured in the receptacle 16 of the present invention 10 which is secured in the ground 56 as previously described.

Figure 6:
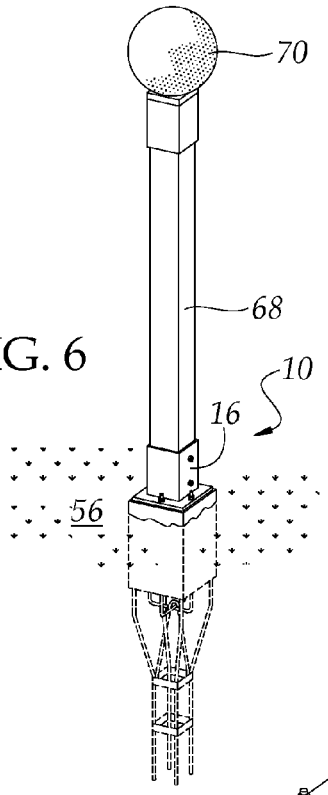
FIG. 6 is a perspective view of an embodiment of the present invention.

Turning to FIG. 6, therein is shown an exemplary use of the present invention 10 wherein a street light pole 68 is shown for supporting a light 70 on top in the conventional manner wherein the light pole is mounted into a complementarily sized and shaped receptacle 16 of the present invention 10 wherein the present invention 10 is secured below the surface of the ground 56 as previously described.

Figure 7:
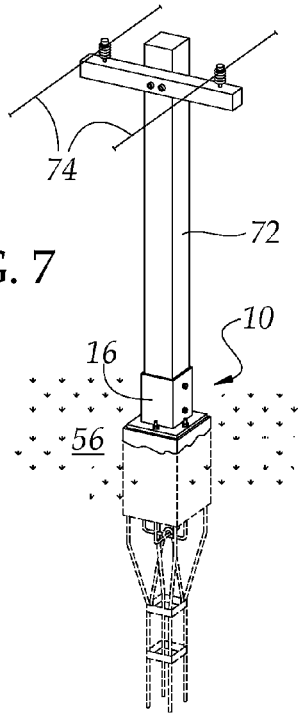
FIG. 7 is a perspective view of an embodiment of the present invention.

Turning to FIG. 7, therein is shown an exemplary use of the present invention 10 wherein a telephone pole 72 is shown for supporting at least one telephone line 74 on top in the conventional manner wherein the telephone pole is mounted into a complementarily sized and shaped receptacle 16 of the present invention 10 wherein the present invention 10 is secured below the surface of the ground 56 as previously described.

Turning to FIGS. 8-12, therein are shown attachments 76, 78, and 80 for being mounted on the top end of the present invention 10 so that the foundation of a building can be supported above the surface of the ground 56 so as to provide a crawl space thereunder as generally shown in FIG. 12. Each attachment 76, 78 and 80 has an upwardly disposed channel 84 therein mounted on plate 86 which is mounted on a receptacle 88 which receptacle receives an upper end portion of beam 24 as shown in FIG. 12. Plate 86 and receptacle 88 together form an upper receptacle member 90 which is similar to the previously disclosed upper receptacle 16 as shown in FIGS. 1-3, except receptacle 90 is downwardly disposed for receiving the upper end portion of upright member 24 and receptacle 16 is upwardly disposed for receiving the lower end portion of upright member 24. Attachments 76, 78 and 80 are each attached by welding or the like to plate 96. Receptacle member 90 is attached to the upper end portion of a beam similarly to the lower receptacle 16 using lag bolts or the like which pass through apertures 89.

Figure 8:
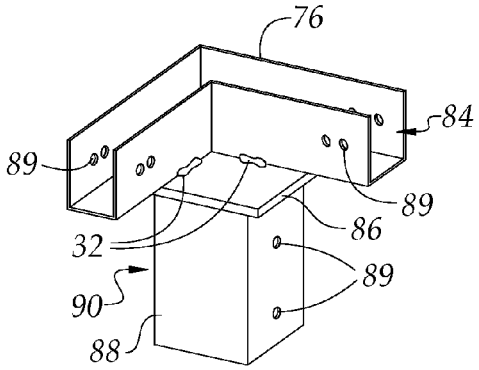
FIG. 8 is a perspective view of a channel member for use with the present invention.
Figure 9:
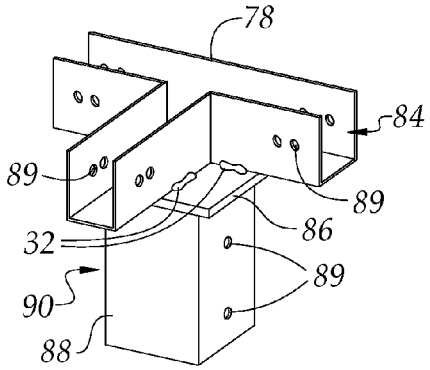
FIG. 9 is a perspective view of a channel member for use with the present invention.
Figure 10:
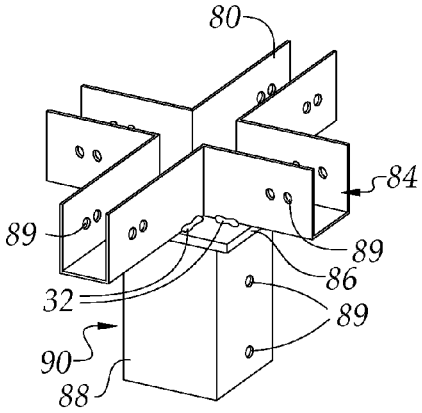
FIG. 10 is a perspective view of a channel member for use with the present invention.

FIG. 8 shows attachment 76 configured for use at the corner of a building foundation 82 having a channel 84 therein for receiving the corner of foundation 82 as shown in FIG. 11. FIGS. 9 and 10 show attachments 78, 80 configured for use on the side wall and an interior wall, respectively, of building foundation 82 as shown in FIG. 11. FIG. 11 shows the locations of attachments 76, 78 and 80 being placed about foundation 82 as would be done in the standard manner by one skilled in the art.

FIG. 12 shows an illustrative building wall section 92 having a top plate 94 and a bottom plate 96 supported by floor joists 98, 100 which joists are cradled or supported in the channel 84 of attachment 78 which is mounted on the upper end of upright member 24 so as to create a crawl space 108 under the building. Joists 98, 100 are similar members, such as a header of a joist or the like, of a building foundation as shown as members 82 in FIG. 11. Also shown are all-thread rods 102 extending from the top of top plate 94 to the underside of attachment 78 for joining all components of wall section 92 together. Fasteners 104 or the like and brackets 106 are also shown on top of top plate 94. It is believed that this typical wall section 92 would comply with applicable building codes for these type structures.

Approximate dimensions, which are provided for illustration only, are as follows: depth of hole 54 about 42 inches; about 520 pounds of cement 44 to fill the hole; rebar ends 47 extend about 6 inches into soil 56; plate 30 is about 8½ inches square and about 3/16 inch thick; and, receptacle 16 is about 8 inches long and sized to receive an about 6 inch by 6 inch beam 24.

I claim:

1. An assembly for anchoring a beam, comprising:

a) a vertically extending solid beam to be anchored;

b) a receptacle enclosing a bottom portion of said beam;

c) said receptacle resting on and attached to a horizontally extending base plate;

d) said base plate forming a top cover for a downwardly extending enclosure, said enclosure having walls with interior surfaces and a bottom opening;

e) a U-bolt being disposed in an interior of said enclosure, said U-bold having a pair of upwardly extending legs with bottoms of said legs connected to each other by a base portion, wherein said legs extend through and are secured to said base plate;

f) a plurality of reinforcing bars disposed against and attached directly to the interior surfaces of the walls of said enclosure and extending downwardly from said enclosure, wherein said reinforcing bars terminate below said base plate;

g) a joining rebar looped over said base portion of said U-bolt and extending downwardly and having distal ends; and h) a structure for attaching the distal ends of said joining rebar to said reinforcing bars below said enclosure, whereby said assembly when embedded in ground forms a structure having flexibility contributing to structural strength resistant to lateral forces produced by a tornado or hurricane.

2. The assembly of claim 1, further comprising:

a) wherein said reinforcing bars have top ends disposed parallel to each other; and b) wherein said base plate has a greater diameter than said receptacle so that a portion of said base plate extends laterally beyond said enclosure, a flange being formed by said portion of said base plate which extends beyond said enclosure, wherein said flange has a plurality of apertures therein, said apertures extending entirely through said base plate.

3. The assembly of claim 2, in which said structure for attaching distal ends comprises a band surrounding said reinforcing bars and distal ends of said joining rebar.

4. The assembly of claim 1, wherein said enclosure has a cross section shape selected from the group consisting of rectangular, square and circular.

5. The assembly of claim 1, wherein said ground has a hole, said receptacle is partially within said hole so that said base plate is above ground surface, and said hole is filled with concrete or cement which fills said enclosure.

6. The assembly of claim 5, wherein said reinforcing bars converge partially below said bottom opening of said receptacle and are attached to said distal ends of said joining rebar where convergence is ended and where said distal ends of said joining rebar join said reinforcing bars.

7. The assembly of claim 6, wherein said distal ends of said joining rebar are attached to said reinforcing bars using a band surrounding said reinforcing bars and said distal ends of said joining rebar.

8. A method for anchoring a beam comprising the steps of:

a) providing a vertically extending solid beam to be anchored;

b) providing a receptacle enclosing a bottom portion of said beam, said receptacle resting on and attached to a horizontally extending base plate;

c) using said base plate to form a top cover for a downwardly extending enclosure, said enclosure having walls with interior surfaces and a bottom opening;

d) providing a U-bolt in an interior of said enclosure, said U-bolt having a pair of upwardly extending legs with bottoms of said legs connected to each other by a base portion, wherein said legs extend through and are secured to said base plate;

e) providing a plurality of reinforcing bars, wherein each reinforcing bar has upper and lower end portions, wherein the reinforcing bars are spaced apart from each other, said upper portions being disposed against and directly attached the interior surfaces of the walls of said enclosure, said lower portions extending downwardly from a lower end of said enclosure, wherein said reinforcing bars terminate below said base plate;

f) using a joining rebar to connect said base portion of said U-bolt to said reinforcing bars below said enclosure and said base portion of said U-bolt; and g) disposing portions of the plurality of reinforcing bars, the enclosure, and the U-bolt in a concrete foundation so that the beam is anchored whereby said assembly when embedded in ground forms a structure having flexibility contributing to structural resistant to lateral forces produced by a tornado or hurricane.

9. The assembly of claim 8, wherein the enclosure is rectangular in shape.

10. The assembly of claim 8, wherein the enclosure is round in shape.

11. The assembly of claim 8, wherein the receptacle is rectangular in shape.

12. The assembly of claim 8, wherein the receptacle is round in shape.

13. A method for anchoring a beam supporting a wall structure, comprising the steps of:

a) enclosing a bottom portion of a vertically extending solid beam to be anchored with a first receptacle, said receptacle resting on and attached to a horizontally extending base plate;

b) said base plate forming a top cover for a downwardly extending enclosure, said enclosure having walls with interior surfaces and a bottom opening;

c) disposing a U-bolt in an interior of said enclosure, said U-bolt having a pair of upwardly extending legs with bottoms of said legs connected to each other by a base portion, with said legs extending up through and secured to said base plate;

d) placing and attaching a plurality of reinforcing bars up against the interior surfaces of the walls of said enclosure, said reinforcing bars extending downwardly from said enclosure, wherein said reinforcing bars terminate below said base plate;

e) looping a joining rebar over said base portion of said U-bolt and extending said joining rebar having distal ends downwardly;

f) attaching said distal ends of said joining rebar to said reinforcing bars below said enclosure and said base portion of said U-bolt;

g) embedding a portion of said first receptacle in a ground opening;

h) enclosing a top portion of said beam with a second enclosure having an open bottom to receive said beam and a top plate covering a top opening;

i) mounting floor joists supporting said wall structure on said top plate, whereby a crawl space is created under said top plate; and j) filling said ground opening with concrete, whereby said assembly forms a structure having slight flexibility contributing to structural strength resistant to lateral forces produced by a tornado or hurricane.

* * * * *